US010166452B2

(12) United States Patent
Thomas, III

(10) Patent No.: US 10,166,452 B2
(45) Date of Patent: Jan. 1, 2019

(54) BAT SWING TRAINING DEVICE

(71) Applicant: Downey L. Thomas, III, Long Beach, CA (US)

(72) Inventor: Downey L. Thomas, III, Long Beach, CA (US)

( * ) Notice: Subject to any disclaimer, the term of this patent is extended or adjusted under 35 U.S.C. 154(b) by 0 days.

(21) Appl. No.: 15/147,976

(22) Filed: May 6, 2016

(65) Prior Publication Data

US 2016/0325165 A1 Nov. 10, 2016

Related U.S. Application Data

(60) Provisional application No. 62/158,047, filed on May 7, 2015.

(51) Int. Cl.

| | |
|---|---|
| ***A63B 69/00*** | (2006.01) |
| ***A63B 15/00*** | (2006.01) |
| ***A63B 59/55*** | (2015.01) |
| ***A63B 60/34*** | (2015.01) |
| ***A63B 60/06*** | (2015.01) |
| ***A63B 59/58*** | (2015.01) |
| *A63B 102/18* | (2015.01) |

(52) U.S. Cl.

CPC ..... *A63B 69/0002* (2013.01); *A63B 15/00* (2013.01); *A63B 59/55* (2015.10); *A63B 59/58* (2015.10); *A63B 60/06* (2015.10); *A63B 60/34* (2015.10); *A63B 2069/0008* (2013.01); *A63B 2102/18* (2015.10)

(58) Field of Classification Search

CPC ..... A63B 69/0002; A63B 59/55; A63B 59/58; A63B 60/34; A63B 15/00; A63B 2102/18; A63B 2069/0008

USPC ..... 473/457, 438, 422, 226, 231, 288, 294, 473/568; D21/727, 725, 736, 757

See application file for complete search history.

(56) References Cited

U.S. PATENT DOCUMENTS

| | | | | | |
|---|---|---|---|---|---|
| 1,979,174 | A | * | 10/1934 | Robertson | A63B 53/14 473/204 |
| 1,990,281 | A | * | 2/1935 | Grelle | A63B 69/3632 473/232 |
| 3,246,894 | A | * | 4/1966 | Salisbury | A63B 69/0002 473/457 |
| 3,554,545 | A | * | 1/1971 | Mann | A63B 59/50 473/564 |
| 3,874,668 | A | * | 4/1975 | Flege | A63B 69/3685 473/227 |
| 4,092,719 | A | * | 5/1978 | Salmon | B23P 19/102 29/711 |
| 4,186,528 | A | * | 2/1980 | Yascheritsyn | B24B 1/005 451/113 |
| D256,824 | S | * | 9/1980 | Ward | D21/736 |
| D263,329 | S | * | 3/1982 | Clayton | D21/727 |

(Continued)

*Primary Examiner* — Mitra Aryanpour
(74) *Attorney, Agent, or Firm* — David B. Waller

(57) ABSTRACT

The present invention is a bat swing training device and methods of using the device to increase accuracy when hitting a ball with a bat. The training device has a bottom end having a knob, a handle next to the knob and a shaft next to the handle and a top end having a barrel for hitting the ball. The handle is a non-round-cylinder shape and the shaft has a means for maintaining a desired orientation of the bat at the moment of contacting a ball. The method includes the steps of gripping and swinging the training device while maintaining the desired orientation and repeating the swing improving hitting accuracy.

2 Claims, 1 Drawing Sheet

(56) References Cited

U.S. PATENT DOCUMENTS

D263,863 S * 4/1982 Golab ..... D21/725
4,752,070 A * 6/1988 Hansen ..... A63B 60/02 473/437
4,795,153 A * 1/1989 Thomas ..... A63B 53/007 473/316
5,125,130 A * 6/1992 Stanish ..... B25G 1/102 473/204
5,328,185 A * 7/1994 Finnigan ..... A63B 53/007 473/294
5,616,087 A * 4/1997 Bothwell ..... A63B 53/00 473/288
5,792,002 A * 8/1998 Bothwell ..... A63B 53/00 473/288
5,816,952 A * 10/1998 Blevins ..... A63B 69/0059 473/450
6,059,675 A * 5/2000 Finn ..... A63B 59/50 473/457
6,190,266 B1 * 2/2001 Pamias ..... A63B 53/02 473/294
6,416,419 B1 * 7/2002 Foresi ..... A63B 69/0059 473/227
7,041,017 B1 * 5/2006 Carfo ..... A63B 15/00 473/422
7,351,167 B1 * 4/2008 Hathaway ..... A63B 69/0002 473/457
8,282,510 B1 * 10/2012 Englund ..... A63B 59/50 473/422
D676,912 S * 2/2013 Lee ..... D21/757
D752,166 S * 3/2016 Kozac ..... D21/727
9,616,309 B2 * 4/2017 Brownstein ..... A63B 69/0002 473/457
2012/0172157 A1 * 7/2012 McCrory ..... A63B 69/0002 473/457
2012/0220396 A1 * 8/2012 Petersen ..... A63B 69/0002 473/457
2015/0273305 A1 * 10/2015 Haro ..... A63B 69/0002 473/457
2016/0325165 A1 * 11/2016 Thomas, III ..... A63B 69/0002 473/457

* cited by examiner

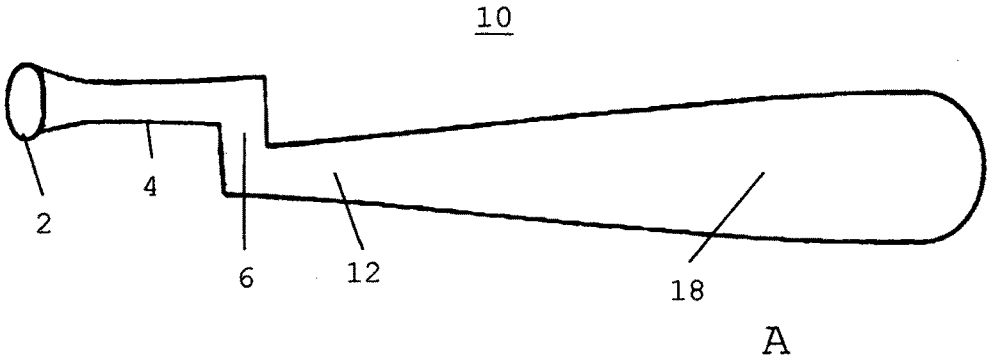
10
2
4
6
12
18
A
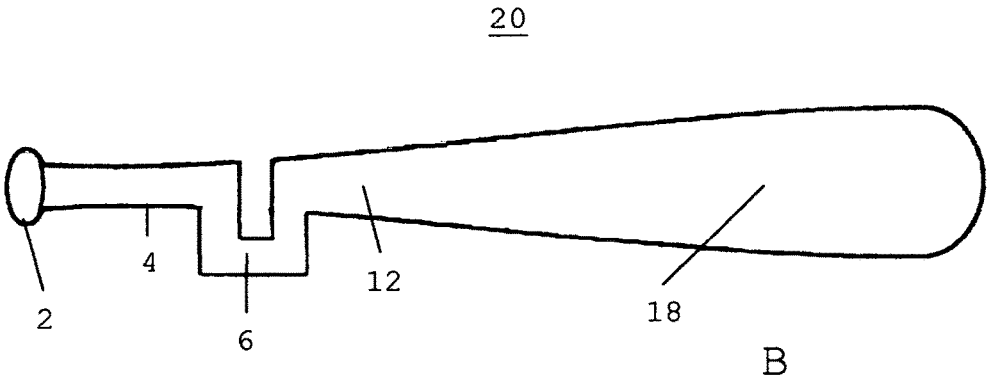
20
2
4
6
12
18
B
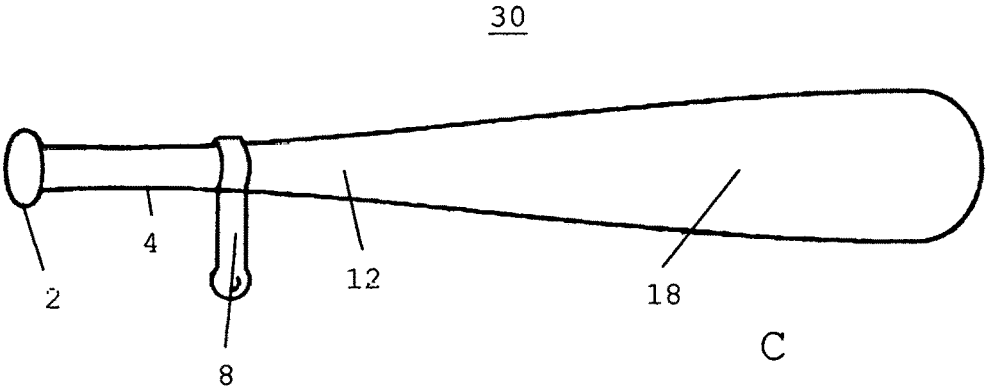
30
2
4
8
12
18
C

BAT SWING TRAINING DEVICE

CROSS-REFERENCE TO RELATED APPLICATIONS

Not applicable

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

TECHNICAL FIELD

This invention relates to the general field of sports, and more specifically toward a device that trains the user how to swing a bat effectively when playing a sport like baseball or softball.

BACKGROUND OF THE INVENTION

There are a variety of devices that have been developed to train players how to swing a bat to achieve a desired result when playing sports like baseball or softball. One of the most common training devices is a weighted bat such as that described in U.S. Patent application 2012/0220396 or weights that may be affixed to the end of the bat such as the donut weight. However, these devices do not train the player on proper orientation of the bat during a swing but merely strengthen the muscles that perform the swing. Other devices that utilize wind resistance have been developed to increase strength and include a parachute or fins attached to the end of a bat.

Other devices such as that described in U.S. Pat. No. 8,282,510 combine increased weight with a narrower hitting surface that mimics the center of a regular bat's hitting surface on the barrel. This narrower surface is intended to train the player to hit the center of the bat during a swing. However, these devices do not train a fixed orientation of the hands and wrist during a swing. More specifically this device is not designed to train the muscles that control the rotation of the wrist to maintain their orientation when swinging a bat.

U.S. Pat. No. 7,351,167 provides an adapter to be affixed to a bat that aids in maintaining the knuckles of the batter in the proper alignment during a swing. This elongated ridge that is positioned under the knuckles of the player when gripping the bat forcing the knuckles in a desired alignment when swinging. Unfortunately, the ridge creates an unnatural grip and does not prevent the rotation of the wrist when swinging the bat.

U.S. Pat. No. 7,041,017 is directed to a baseball training aid having a flat plane indicator on the knob of the device that "can be felt between the batter's wrist" that "will develop muscle memory so the user will create a level swing and develop proper hand placement on the bat". The barrel of the bat is flat and "extends approximately 13 inches in length and extends along the longitudinal axis of the front portion of the bat." Unfortunately, the flat plain indicator could cause injury if not used properly and is structurally different from a regulation bat used during play. In addition, the surface of the barrel has been flatted which prevents the user from creating muscle memory for hitting the center of the bat during a level swing. Consequently, this device does not distinguish on the muscle memory it creates. Meaning the muscle memory may be created for hitting the ball in the center of the bat but also for hitting the top surface creating a "pop-fly" as well as hitting the bottom surface creating a "grounder".

Therefore, there is a need in the sports industry for a device that trains the user to maintain a desired orientation of the bat at the moment of contact, hit the ball on the center of the bat barrel, reduce rotation of the wrists during a swing and provides these characteristics in a device that closely resembles a normal regulation bat.

SUMMARY OF THE INVENTION

The present invention provides a bat swing training device comprising a bat having a means for maintaining the orientation of the bat during a swing. The device has a bottom end and a top end. The bottom end contains a knob, a non-round cylindrical-shaped handle next to the knob and a shaft next to said handle having a means for maintaining the desired orientation of the bat during a swing. The top end is a barrel next to said shaft where the ball contacts the device.

In one embodiment, the non-round cylindrical-shaped handle is approximately oval or rectangular in shape.

In another embodiment, the means for maintaining a desired bat orientation comprises a first bend in the shaft of about 45 to about 90 degrees and a second bend of about 45 to about 90 degrees wherein the first and second bends are in the plane of the handle and barrel. In one configuration of this embodiment, the first and second bends maintain the handle and barrel parallel to one another. This configuration may be a straightened "Z" with sharp corners or may be provided with more gradual corners forming an "S" shape.

In yet another embodiment, the means for maintaining a desired bat orientation comprises four bends in the shaft of about 45 to about 90 degrees wherein all four bends are in the plane of the handle and barrel. In one configuration of this embodiment, the four bends maintain the handle and barrel parallel to and in line with one another.

In still another embodiment, the means for maintaining a desired bat orientation comprises a weighted leverage bar affixed to and extending about perpendicular from said shaft.

Another aspect of this invention is a method for training a batter to swing a bat. The method comprises the steps of gripping the bat swing training device described above and swinging the device maintaining the bat in the proper orientation through the swing and directed away from an incoming ball when contacting the ball and repeating the swing until the desired orientation of the bat is maintained consistently over repeated swings.

DESCRIPTION OF THE FIGURES

FIG. 1: (A) is a diagrammatic representation of one embodiment of the invention having two bends in the shaft, (B) is a diagrammatic representation of one embodiment of the invention having four bends in the shaft, and (C) is a diagrammatic representation of one embodiment of the invention having a weighted leverage bar.

DETAILED DESCRIPTION

Unless defined otherwise, all terms used herein have the same meaning as are commonly understood by one of skill in the art to which this invention belongs. All patents, patent applications and publications referred to throughout the disclosure herein are incorporated by reference in their entirety. In the event that there is a plurality of definitions for a term herein, those in this section prevail.

The phrase "means for maintaining a desired orientation", "means for maintaining orientation", "the means" or "means" as used herein refers to a configuration of the bat swing training device shaft or an element affixed to the device's shaft. When the means for maintaining the desired orientation is built into the configuration of the shaft a portion of the shaft extends from 45 to 90 degrees from the handle. During use that extension of the shaft is on the opposite side from the ball contact location on the barrel. When the means for maintaining the desired orientation is an element affixed to the shaft of the device, the weighted potion of the element extends a given distance and about 90 degrees from the handle on the opposite side from the ball contact location. In both cases, the configuration of the shaft or the element affixed to the shaft, the means acts as leverage creating a rotational force in the handle. This action requires that the user exert enough force with their grip to prevent rotation of the bat during the swing. By maintaining the orientation of the means during the swing it prevents rotation of the wrists increasing the chance of a desired contact with the ball and repeated uses of the bat swing training device results in muscle memory that will improve hitting.

The term "about" or "approximately" as used herein refer to an numerical value, amount or magnitude that may vary in a range from 1% to 15% and preferably from 5% to 10% or any specific percentage in either range.

The term "increase accuracy" as used herein refers to enabling the hitter to contact the ball at the center of the barrel, also referred to as "on the screws", with more consistency reducing pop-up fly balls and lazy ground balls while increasing line drive hits.

The present invention provides a bat swing training device comprising a bat having a means for maintaining the orientation of the bat during a swing. The device has a bottom end and a top end. The bottom end contains a knob, a non-round cylindrical-shaped handle next to the knob and a shaft next to said handle having a means for maintaining the desired orientation of the bat during a swing. The top end is a barrel next to said shaft where the ball contacts the device.

I. Knob

The knob 2 is positioned at the base of the handle 4 of the device (10, 20 and 30) and is provided as a stop for the hands of the user to prevent the device from inadvertently being released during a swing. It may be provided in a variety of shapes. In one embodiment, the knob 2 is round when viewed from the end of the device (10, and 30) and oval when viewed from the side. In this configuration, the diameter of the knob 2 may be from about 40 mm to about 70 mm and has a thickness of from about 15 mm to about 30 mm. The angle formed between the knob 2 and the handle 4 may be 90 degrees. Alternatively, the side of the knob 2 contacting the handle may be sloped from the knob's perimeter edge to the handle's 4 surface. The angle created between this slope and the side of the knob 2 contacting the handle 4 may be from about 5 degrees to about 60 degrees. The diameter of the knob 2, the thickness of the handle 4 and the angle of the slope will determine the distance the slope extends onto the handle 4. So for example, if the knob 2 diameter is 40 mm having a thickness of 20 mm, with a handle 4 diameter of 25 mm and the slope angle from the handle 4 to the knob 2 being 30 degrees the distance along the handle 4 that the slope will occupy is about 13 mm. This distance may range from about 10 mm to about 50 mm.

The knob 2 may be made from a variety of materials including wood, polymer or metal. It may be made of the same or different material as the handle 4, shaft 12 or barrel 18. Preferably it is made of the same material as the handle 4.

II. Handle

The handle 4 extends from the knob 2 and is provided in a sufficient length and texture to allow the user to securely grip the device (10, 20 and 30) during use. The handle 4 may be provided in a variety of cross-sectional shapes. In one embodiment, the cross-section is round as is the case with regulation bats. In another embodiment, the shape aids the user in determining the orientation of the bat during a swing. For example, the cross-section may be square, oval or rectangular.

The handle 4 is straight as with regulations bats having a length that ranges from about 160 mm to about 350 mm and a diameter of about 25 mm to about 45 mm. The handle 4 may be provided with or without a textured coating for training purposes.

The handle 4 may be made from a variety of materials including wood, polymer or metal. It may be made of the same or different material as the shaft 12 or barrel 18. Preferably it is made of the same material as the shaft 12.

III. Means for Maintaining Orientation

The means for maintaining orientation 6 and 8 assists the user in maintaining the proper orientation of the device (10, 20 and 30) during a swing, which results in muscle memory after repeated use of the device (10, 20 and 30). This means 6 and 8 moves the device's (10, 20 and 30) center of gravity from along its longitudinal axis to a fixed distance from the longitudinal axis of the handle 4. By shifting the center of gravity the device (10, 20 and 30) creates the normal downward gravitational force along the longitudinal axis as well as an additional rotational force exerted to the handle 4. Moving the center of gravity may be accomplished by shifting a portion of the longitudinal axis of the shaft 12 and barrel 18 from the handle 4 or by providing a weighted element on the shaft 12 or barrel 18 that introduces rotational leverage on the handle 4. In the latter configuration, the combination of the weighted element and the bat may be set to be the same weight as a conventional bat used by a batter if desired.

A number of configurations may be utilized to accomplish this orientation of the devices (10, 20 and 30) center of gravity. For example, the barrel's longitudinal axis may be repositioned behind or in front of the longitudinal axis of the handle 4, (10), a portion of the shaft 12 may be extended from the longitudinal axis of the device with sufficient weight to create rotational leverage at the handle 4, (20) or a weighted leverage bar 8 may be affixed to the shaft 12 or barrel 18 of the device to create rotational leverage in the handle 4, (30).

In one embodiment (see FIG. 1 A), the shaft 12 and barrel 18 are shifted from the longitudinal axis of the handle (10). This shift may be created by introducing two bends in the shaft 12. These bends may be provided at angles ranging from about 45 degrees to about 90 degrees. The resulting configuration displaces the longitudinal axis of the handle 4 from the shaft 12 and barrel 18 from about 50 mm to about 150 mm. These bends may be sharp bends like those shown in FIG. 1A or may be more gradual forming the shape of an "S".

In another embodiment (see FIG. 1B), four bends are introduced into the shaft wherein the angles range from about 45 degrees to about 90 degrees (20). These bends can maintain the position of the longitudinal axis of the handle 4 and barrel 18 in alignment or may displace the longitudinal axis of the handle 4 from the shaft 12 and barrel 18 from about 50 mm to about 100 mm. In this embodiment, the handle 12, barrel 18 and means 6 are in the same plane.

In yet another embodiment (see FIG. 1C), a weighted leverage bar 8 having a clamping element on one end and weighted element on the other is affixed to the shaft 12 of barrel 18 of the device (30) to create the rotational leverage in the handle 4.

In each of these embodiments the means 6 may be made from a variety of materials including polymer or metal. It may be made of the same or different material as the shaft 12 or barrel 18. Preferably it is made of the same material as the barrel 18 and/or handle 4.

IV. Barrel

The barrel 18 of the device (10, 20 and 30) is constructed similarly to the barrel 18 of bats currently sold commercially or regulation bats utilized in the sports industry and are designed as the contact surface for the ball during use. The length and diameter of the barrel 18 will vary depending on the rules regulating the size, weight, shape and material of bats in the industry or for specialized play such as Little League for children or other sports that utilize a bat to hit a ball. In general, the barrel 18 of the bat usually widens from where it connects to the shaft 12 for a distance and then retains the larger diameter for a distance before terminating in the end of the device (10, 20 and 30). The length of the barrel 18 may range from about 300 mm to about 675 mm with a diameter of about 60 mm to about 90 mm. The fixed diameter hitting surface of the barrel 18 may range in length from about 200 mm to about 350 mm.

In addition, the weight of the bat may be distributed differently among the elements depending on the desires of the batter. For example, a batter may prefer that a majority of the weight be distributed to the barrel while other may prefer that the barrel be lighter. Consequently the device of the resent invention will provide these options for the user.

Assembly

The device of the present invention may be provided in a single piece of may be constructed of multiple pieces. In a preferred embodiment the device is constructed of a single of polymer or metal that is form-molded, milled or extruded. Alternatively, the knob, handle and means may be made of one material and the shaft and barrel made of a different material or the knob, handle, and barrel may be made of one material and the means and shaft made of a different material. If more than on piece is utilized to prepare the device interlocking joints with adhesives or similar methods known in the art may be used to assure that the pieces do not come apart during use.

Use

The device may be used with automated and non-automated pitching. Before taking a batter's stance the device is held out in the position in which the user intends to contact the ball with the barrel of the device making sure that the means for maintaining orientation is about parallel to the ground. The bat is then drawn back for the swing and the user takes the batter's stance and readied for the pitch. When the pitch reaches the hitting zone after being released, the batter begins his/her swing making sure that the means for maintaining orientation is in the same position as it was when setting up for the pitch and at the moment of contacting the ball.

The induced rotational force on the handle will require that the batter securely grip the handle to prevent rotation and the orientation of the means will assist in assuring that the batter does not rotate his/her wrist when swing the device. The weight of the device may be increased with the addition of the means for maintaining orientation. More specifically, different weights may be utilized on the weighted leverage bar element or a heavier gauge material may be used in preparing the means. This will assist in increasing the force of the batter's swing when using a regulation bat.

I claim:

1. A bat swing training device comprising:

a bat having a first end and a second end, a handle portion positioned at said first end of the bat and having a length from about 160 mm to about 350 mm, wherein said handle portion includes a knob;

a barrel portion positioned at said second end of the bat and having a diameter from about 60 mm to about 90 mm, and a length from about 300 mm to about 675 mm, wherein the barrel portion widens from the shaft portion for a distance and then retains a larger diameter for a distance before terminating in the second end;

a shaft portion having a length from about 50 mm to about 150 mm, wherein the shaft portion is positioned between the handle portion and the barrel portion;

wherein said shaft portion includes a first bend of about 90 degrees and a second bend of about 90 degrees, and wherein said first and said second bends form a plane with said handle portion and said barrel portion; and wherein said barrel portion and handle portion include a longitudinal axis, and wherein said longitudinal axis of said barrel portion is parallel to said longitudinal axis of said handle portion and said handle portion and said barrel portion do not have the same longitudinal axis.

2. The bat swing training device according to claim 1, wherein said handle portion is oval or rectangular in shape.

* * * * *